US006553706B1

(12) United States Patent
Gancarz et al.

(10) Patent No.: US 6,553,706 B1
(45) Date of Patent: Apr. 29, 2003

(54) SEAR AND STEP TRIGGER ASSEMBLY HAVING A SECONDARY SEAR BLOCK

(76) Inventors: Robert M. Gancarz, 98 Szetela Dr., Chicopee, MA (US) 01013; Scott Warburton, 1628 Center St., Ludlow, MA (US) 01056

( * ) Notice: Subject to any disclaimer, the term of this patent is extended or adjusted under 35 U.S.C. 154(b) by 0 days.

(21) Appl. No.: 09/878,600

(22) Filed: Jun. 11, 2001

(51) Int. Cl.[7] ..... F41A 3/00
(52) U.S. Cl. ..... 42/69.02; 42/70.01
(58) Field of Search ..... 42/69.01, 69.02, 42/69.03, 1.04, 1.05

(56) References Cited

U.S. PATENT DOCUMENTS

| | | | | | |
|---|---|---|---|---|---|
| 239,652 | A | * | 4/1881 | Fiske | 42/70.01 |
| 290,737 | A | * | 12/1883 | Brown | 42/23 |
| 351,262 | A | * | 10/1886 | Goltstein | 42/70.01 |
| 467,524 | A | * | 1/1892 | Storer | 42/20 |
| 650,829 | A | * | 6/1900 | Evans | 42/10 |
| 741,506 | A | * | 10/1903 | Kirmse | 42/45 |
| 749,877 | A | * | 1/1904 | Neuber et al. | 42/41 |
| 1,041,648 | A | * | 10/1912 | Mauser | 42/70.06 |
| 1,068,752 | A | * | 7/1913 | Febiger | 42/16 |
| 1,593,981 | A | * | 7/1926 | McCrudden | 42/69.01 |
| 1,616,501 | A | * | 2/1927 | Larsen | 42/41 |
| 1,655,446 | A | * | 1/1928 | Von Frommer | 42/41 |
| 2,563,720 | A | * | 8/1951 | Guisasola | 42/17 |
| 2,635,380 | A | * | 4/1953 | Baker et al. | 42/70.06 |
| 2,867,930 | A | * | 1/1959 | Niesp | 42/41 |
| 2,975,680 | A | * | 3/1961 | Wilson | 42/25 |
| 3,020,663 | A | * | 2/1962 | Newson | 42/70.06 |
| 3,184,875 | A | * | 5/1965 | Klebe | 42/69.01 |
| 3,314,183 | A | * | 4/1967 | Center | 42/69.03 |
| 3,747,251 | A | * | 7/1973 | Baker | 42/1.01 |
| 3,979,849 | A | * | 9/1976 | Haskins | 42/1.04 |
| 4,296,564 | A | * | 10/1981 | Oberst | 42/1.04 |
| 4,300,301 | A | * | 11/1981 | Morrison | 42/70.06 |

(List continued on next page.)

FOREIGN PATENT DOCUMENTS

| | | | | |
|---|---|---|---|---|
| DE | 0225891 | * | 9/1910 | 42/70.04 |
| DE | 0643337 | * | 4/1937 | 42/70.04 |
| DE | 0908109 | * | 4/1954 | 42/70.06 |
| DE | 2263888 | * | 7/1973 | 42/70.06 |
| FR | 0137627 | * | 7/1880 | 42/70.06 |
| FR | 0186542 | * | 10/1887 | 42/70.06 |
| FR | 0709725 A | * | 8/1931 | 42/70.06 |
| GB | 0012467 | * | 1/1891 | 42/70.04 |
| GB | 0012467 | * | 6/1901 | 42/70.06 |
| IT | 0462561 | * | 11/1951 | 42/70.06 |

*Primary Examiner*—Charles T. Jordan
*Assistant Examiner*—Denise J Buckley
(74) *Attorney, Agent, or Firm*—MacCord Mason PLLC

(57) ABSTRACT

An improved firearm having a low creep, safety trigger. The firearm includes a frame, a barrel attached to the frame, a firing mechanism, a step having an adjustable step height, an over travel stop, and a sear and step trigger assembly with a secondary sear block. The secondary sear block is selectively movable between a first blocking position and a second non-blocking position.

32 Claims, 6 Drawing Sheets

U.S. PATENT DOCUMENTS 4,422,254 A * 12/1983 McQueen ..... 42/70.05
4,539,889 A 9/1985 Glock ..... 89/147
4,825,744 A 5/1989 Glock ..... 89/145
4,893,546 A 1/1990 Glock ..... 89/145
5,052,141 A * 10/1991 Sammons ..... 42/69.01
5,341,732 A * 8/1994 Landers ..... 42/70.06
5,446,986 A * 9/1995 Blaser ..... 42/42.01
5,465,517 A * 11/1995 Garofalo ..... 42/1.14
5,487,233 A * 1/1996 Jewell ..... 42/69.01
5,560,134 A * 10/1996 Van Niekerk et al. ..... 42/70.06
5,655,326 A 8/1997 Levavi et al. ..... 42/70.01
5,678,342 A * 10/1997 Felk ..... 42/69.02
5,704,149 A * 1/1998 Bethshears ..... 42/1.04
5,857,280 A * 1/1999 Jewell ..... 42/69.03
5,924,231 A * 7/1999 Kidd ..... 42/42.01
6,131,324 A * 10/2000 Jewell ..... 42/69.03
6,212,812 B1 * 4/2001 Aigner ..... 42/70.06
6,283,006 B1 * 9/2001 Szabo et al. ..... 42/69.03
6,293,039 B1 * 9/2001 Fuchs ..... 42/70.04
6,412,206 B1 * 7/2002 Strayer ..... 42/69.03
6,415,539 B1 * 7/2002 Fuchs et al. ..... 42/70.07

* cited by examiner

SEAR AND STEP TRIGGER ASSEMBLY HAVING A SECONDARY SEAR BLOCK

BACKGROUND OF THE INVENTION

1. Field of the Invention

The present invention is directed to a firearm having an improved trigger, and more particularly, to an improved low creep, safety trigger.

2. Description of the Prior Art

Triggers for firearms must strike a compromise between ease of use and safety. Competition triggers eliminate or reduce trigger creep by reducing the amount of sear engagement. In addition, the "feel" of the trigger may be improved by polishing the area between the trigger step and the sear engagement. However, polishing does not reduce the amount of trigger creep, just the "feel" of the trigger creep. On the other hand, a reduction in the amount of sear engagement results in a perceived better trigger pull. For example, a trigger having about 0.015 inches of engagement would be considered by most shooters to be a better trigger than a trigger having about 0.025 inches of engagement.

Most commercial triggers do not have an adjustment screw for reducing the amount of sear engagement and the shooter either must be satisfied with the factory setting or have the trigger re-worked by a qualified gunsmith. Competition rifles, however, often do have trigger adjustments. Some competitors may reduce the amount of trigger pull to under a pound of trigger pull.

Generally, having a sear and step engagement of greater than about 0.020 inches results in a safe, but extremely heavy trigger. Reducing the sear and step engagement to about 0.016 inches results in a low trigger creep, but the firearm could accidentally discharge if jarred or dropped or if the safety is not engaged.

Thus, there is a need for a firearm having a low creep, safety trigger that is operable to stop the sear even in the event that the safety has not been engaged while, at the same time, providing improved trigger pull. Accordingly, the present invention is operable to stop the sear, thereby catching the firing pin before it protrudes from the bolt face and well before the firing pin reaches the rear primer of the cartridge.

SUMMARY OF THE INVENTIOPN

The present invention is directed to an improved firearm having a low creep, safety trigger. The firearm includes a frame, a barrel attached to the frame, a firing mechanism; a step having an adjustable step height, an over travel stop, and a sear and step trigger assembly with a secondary sear block. The secondary sear block is selectively movable between a first blocking position and a second non-blocking position.

The over travel stop may be located between the trigger and the frame. Also, the over travel stop may be located between the rear of the trigger and the safety. Preferably, the over travel stop is an adjustment screw, and further includes a trigger stop and safety. In addition, both the trigger stop and the safety may be an adjustable screw.

The frame may be a bolt-action receiver, and the firing mechanism may include a firing pin and a firing pin actuator. Preferably, the firing pin actuator is a spring. The secondary sear block may be coaxial with the trigger, and preferably, the secondary sear block is nested within the trigger and is finger actuated. Additionally, the secondary sear block may include a biasing means for maintaining the secondary sear block in the block position. An inner lock may be provided between the secondary sear block and the sear.

The firearm also may include a cocking indicator. A trigger return spring may be provided, and preferably, an adjustment screw is included between the trigger return spring and the trigger.

Accordingly, one aspect of the present invention is to provide an improved firearm including a frame, a barrel attached to the frame, a firing mechanism; and a sear and step trigger assembly with a secondary sear block selectively movable between a first blocking position and a second non-blocking position.

Another aspect of the present invention is to provide an improved firearm having a frame, a barrel and a firing mechanism, the improvement including a sear and step trigger assembly includes a sear, a trigger, a step having an adjustable step height, and a secondary sear block selectively movable between a first blocking position and a second non-blocking position.

Still another aspect of the present invention is to provide an improved firearm including a frame, a barrel attached to the frame, a firing mechanism, a step having an adjustable step height, a sear and step trigger assembly with a secondary sear block selectively movable between a first blocking position and a second non-blocking position, and an over travel stop.

These and other aspects of the present invention will become apparent to those skilled in the art after a reading of the following description of the preferred embodiment when considered with the drawings.

DESCRIPTION OF THE PREFERRED EMBODIMENTS

Figure 1:
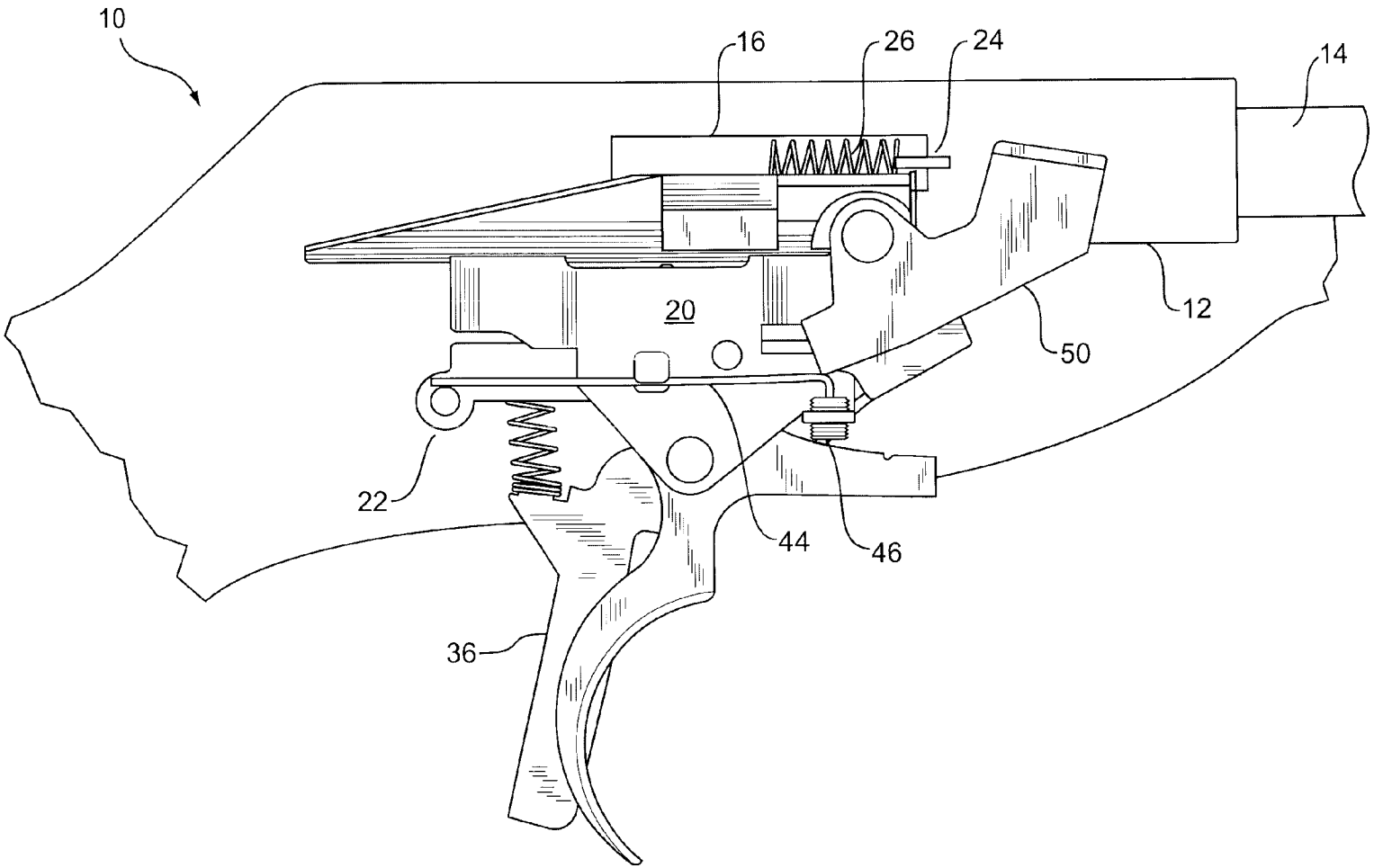
FIG. 1 is a side elevation view of a firearm having a low creep, safety trigger assembly, constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Turning to FIG. 1, there is shown a side elevation view of a firearm, generally designated 10, having a low creep, safety trigger assembly constructed according to the present invention. Firearm 10 is of a conventional design having a frame 12, a barrel 14, a firing mechanism 16, and a trigger assembly 20. In the preferred embodiment, the firearm may further include an over travel stop 22 which further improves the perceived "feel" of the trigger pull by the shooter.

As shown in FIG. 1, the firearm frame of the present invention is preferably a bolt-action receiver connected to barrel 14. Likewise, firing mechanism 16 is generally conventional in design and includes a firing pin 24 and a firing pin actuator 26 which may be a conventional spring.

Figure 2A:
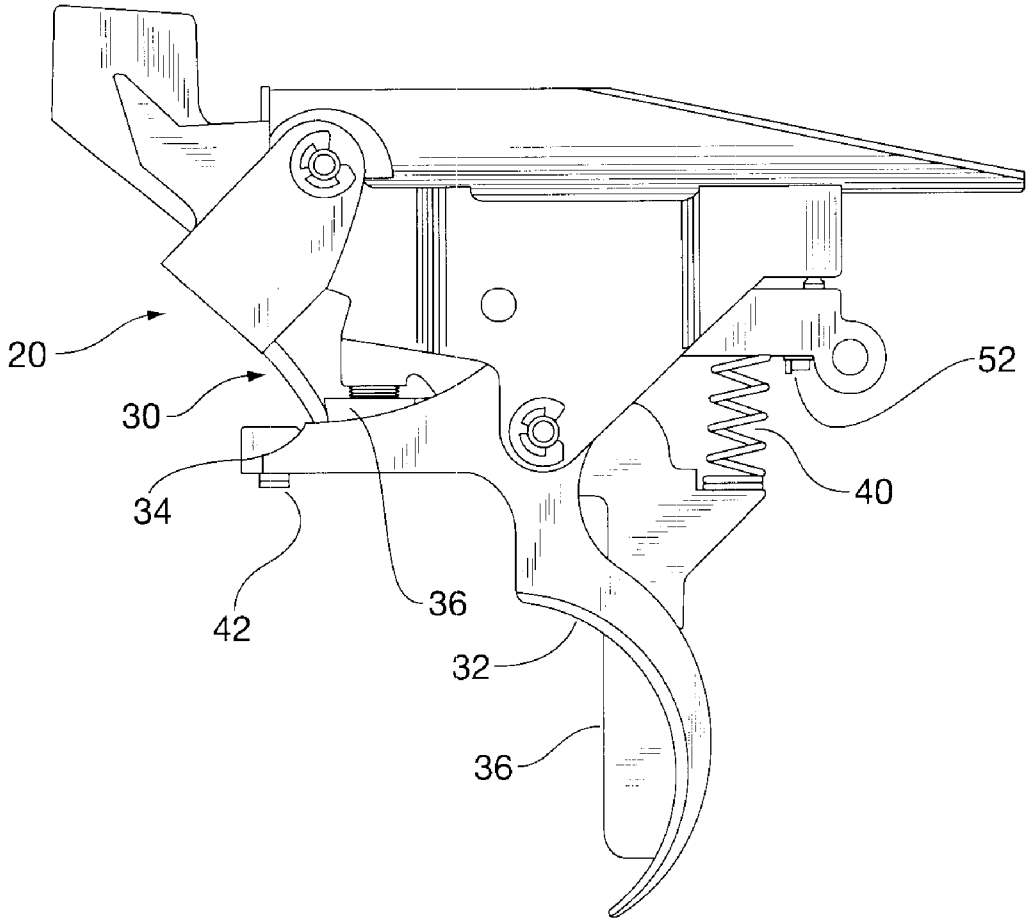
FIG. 2A is a view of the opposite side of the trigger assembly shown in FIG. 1, illustrating the secondary sear block in a blocking position to prevent firing.
Figure 2B:
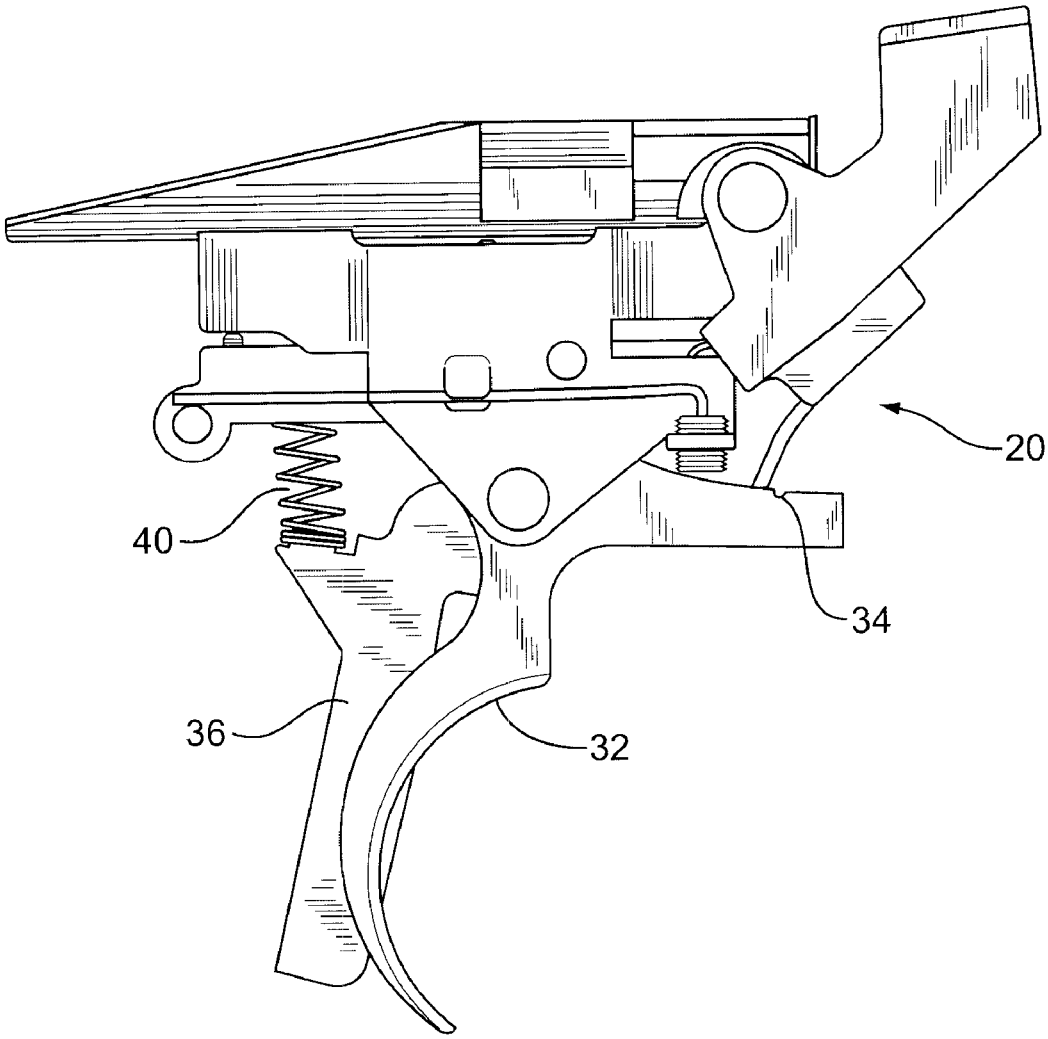
FIG. 2B is a side view of the trigger assembly shown in FIG. 1 illustrating the secondary sear block in a non-blocking position to permit firing.

Turning to FIG. 2A, there is shown an enlarged view of the trigger assembly shown in FIG. 1 illustrating the secondary sear block in place. As can be seen, sear 30 engages a portion of trigger 32 having a step 34. The secondary sear block 36 extends upward adjacent to sear 30 and step 34. The secondary sear block 36 is selectively movable between a first blocking position (shown in FIG. 2A), and a second non-blocking position (shown in FIG. 2B).

Figure 3:
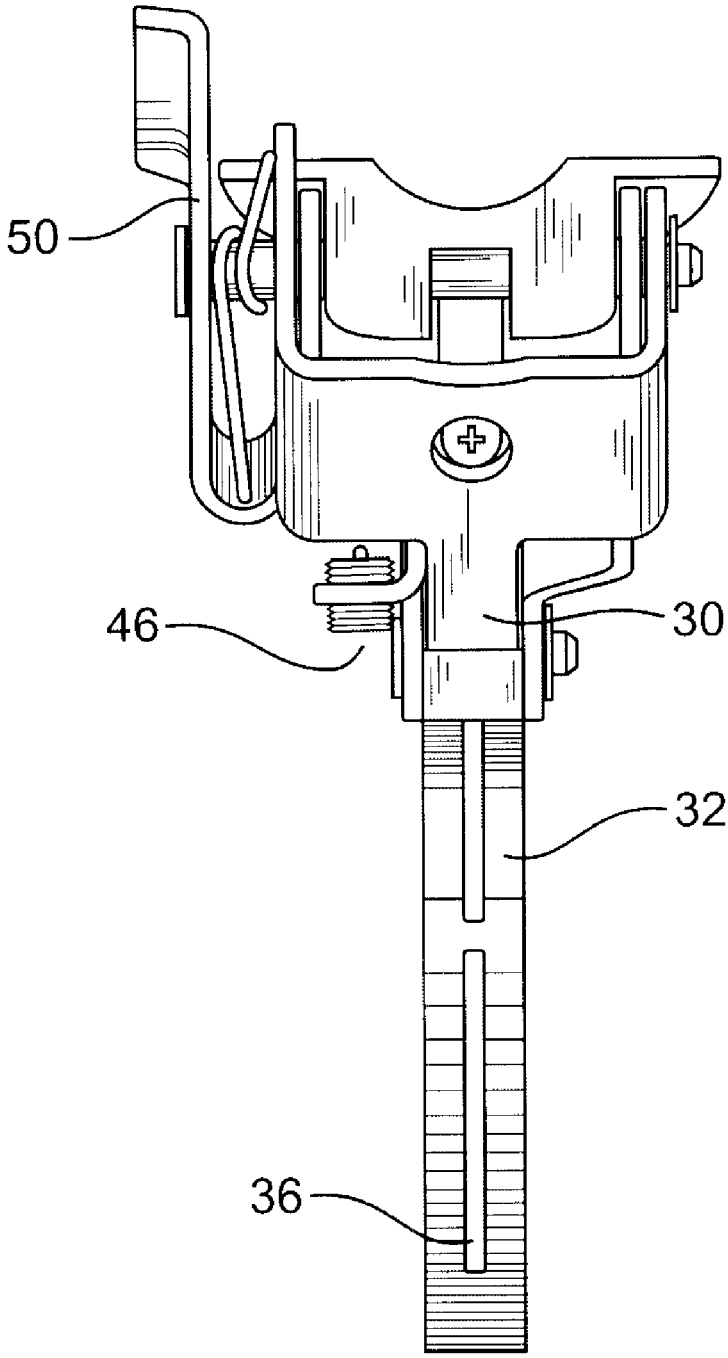
FIG. 3 is a front elevation view of the trigger assembly shown in FIG. 1 illustrating the "nesting" of the secondary sear block within the trigger.
Figure 4:
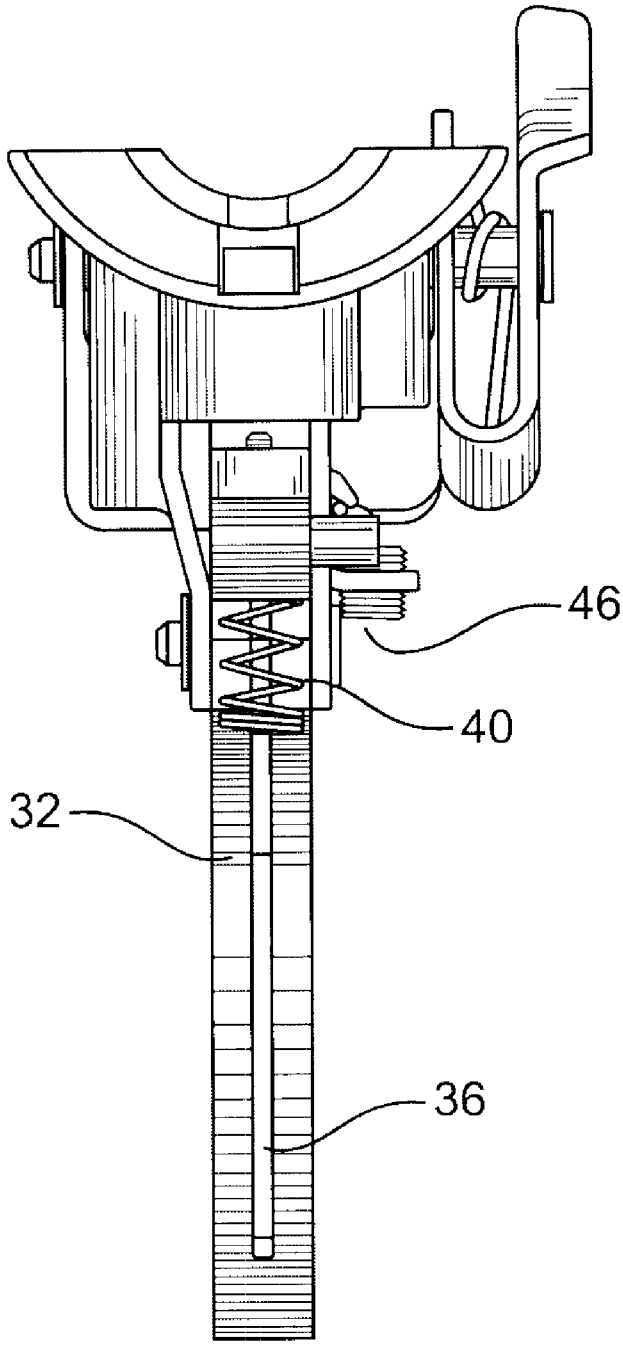
FIG. 4 is a rear elevation view of the trigger assembly shown in FIG. 1 illustrating the secondary sear return spring.

As best seen in FIGS. 3 and 4, the secondary sear block 36 in the preferred embodiment is coaxial with the trigger 32, and in the most preferred embodiment, the secondary sear block 36 is nested within the trigger 32. Spring 40 biases the secondary sear block 36 in its blocked position which, when the shooter depresses the trigger, is moved out of its blocked position before the trigger itself is engaged and the sear released.

As best seen back in FIG. 1, the trigger may further include a trigger return spring 44 and an adjustment screw 46, which returns the trigger and trigger step back into position to re-receive the sear 30 when the gun is re-cocked. Also, in the preferred embodiment, a portion of the sear includes a cocking indicator 50 which extends adjacent to the frame 12 to indicate the firing mechanism 16 is in a cocked position.

Figure 5:
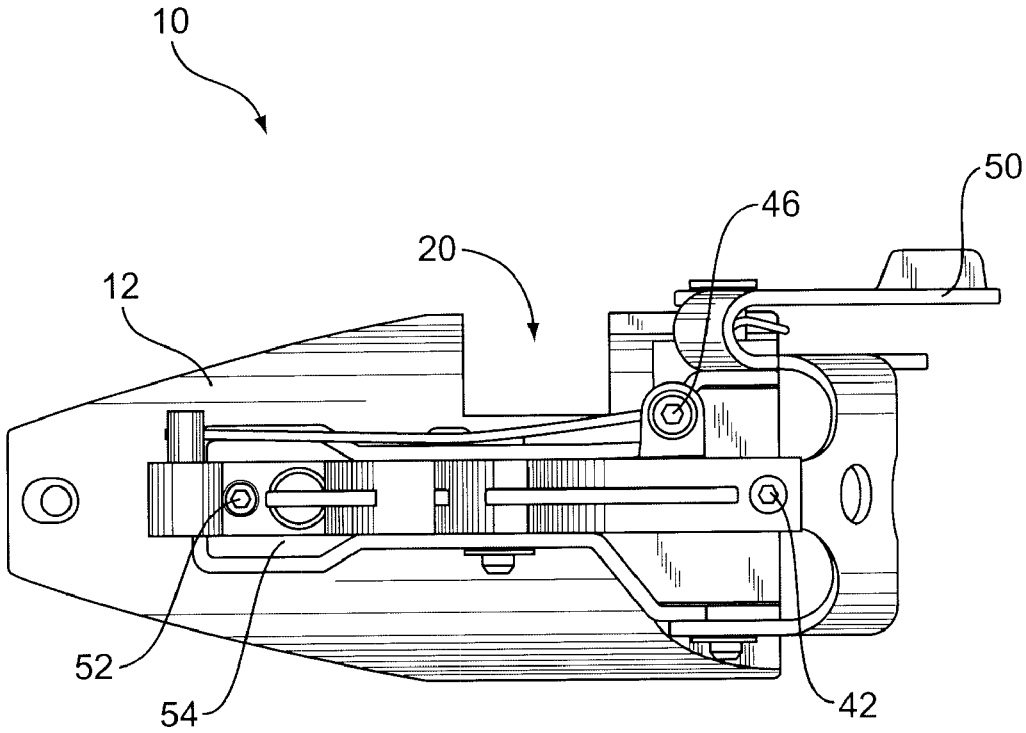
FIG. 5 is a bottom view of the trigger assembly shown in FIG. 1 illustrating the over travel trigger/safety and trigger return spring stop's adjustment locations.

Turning now to FIG. 5, there is shown a bottom view of the trigger assembly shown in FIG. 1 illustrating the over travel stop 22, which is located between the trigger and frame and, in the preferred embodiment, between the rear of trigger and the safety. In the preferred embodiment, the over travel stop 22 is an adjustment screw 52. Also in the preferred embodiment, the over travel stop 22 may further include a trigger stop and safety which also may be an adjustable screw 52. The adjustment screw on the trigger stop and safety 54 engages the safety when the safety is in its forward position and blocks any movement of the trigger.

As best seen in FIGS. 2 and 5, the trigger assembly in the most preferred embodiment also includes an adjustment screw 42 extending through the trigger 32 adjacent and perpendicular to step 34, which reduces the amount of engagement between the distal end of sear 30 and step 34. This adjustment may allow the contact point between the distal end of sear 30 and step 34 to be reduced to less than about 0.020 inches, and preferably less than about 0.015 inches.

In operation, the distal end of the sear 30 engages the step 34 on the trigger 32 when the firearm is cocked. The secondary sear block 36 extends above the trigger 32 in a blocking position. If the safety is off and the firearm is jarred sufficiently to disengage the sear 30 from the step 34, the upward extending secondary sear block 36 blocks the sear 30. The sear 30 in turn blocks the trigger from pivoting sufficiently to actuate the firing mechanism 16. Therefore, the secondary sear block 36 prevents the cocked firearm from accidentally firing even when the safety is off.

To intentionally fire the firearm, the firearm is cocked and the safety is removed. A person then depresses the portion of the secondary sear block 36 protruding above the hook portion of the trigger 32 with the shooter's trigger finger by a simple squeezing motion. Before the person's finger engages the hook portion of the trigger 32, the upwardly extending portion of the secondary sear block 36 drops from its blocking position into a non-blocking position. As the shooter continues to squeeze the trigger, the resultant pivoting motion of the trigger causes the distal end of the sear 30 to disengage from the step 34. Because the secondary sear block 36 is no longer in a blocking position, as the shooter continues to squeeze, the trigger is able to continue through its full firing motion. When the trigger is squeezed sufficiently to actuate the firing mechanism, the firearm is discharged. The over travel stop 22 limits the further motion of the trigger 32. When the shooter releases the trigger, the trigger return spring 44 and spring 40 bias the trigger 32 and secondary sear block 36 toward a pre-cocked position.

We claim:

1. An improved firearm, said firearm including:

(a) a frame;

(b) a barrel attached to the frame;

(c) a firing mechanism; and (d) a sear and step trigger assembly having a trigger and a secondary sear block, said secondary sear block selectively movable between a first blocking position and a second non-blocking position, wherein said secondary sear block is finger actuated next to said finger portion of the trigger.

2. The apparatus according to claim 1, further including an over travel stop.

3. The apparatus according to claim 2, wherein said over travel stop is located between said trigger and said frame.

4. The apparatus according to claim 3, wherein said over travel stop is located rearward said trigger.

5. The apparatus according to claim 4, wherein said over travel stop is an adjustment screw.

6. The over travel stop according to claim 2, further including a trigger stop and safety.

7. The apparatus according to claim 6, wherein said trigger stop and safety is an adjustment screw.

8. The apparatus according to claim 1, wherein said frame is a bolt-action receiver.

9. The apparatus according to claim 1, wherein said firing mechanism includes a firing pin and a firing pin actuator.

10. The apparatus according to claim 9, wherein said firing pin actuator is a spring.

11. An improved firearm having a frame, a barrel and a firing mechanism, the improvement comprising a sear and step trigger assembly with a secondary sear block, said sear and step trigger assembly comprising:

(a) a sear;

(b) a trigger;

(c) a step having an adjustable step height; and (d) a secondary sear block selectively movable between a first blocking position and a second non-blocking position, wherein said secondary sear block is finger actuated next to said finger portion of the trigger.

12. The apparatus according to claim 11, wherein said secondary sear block is coaxial with said trigger.

13. The apparatus according to claim 12, wherein said secondary sear block is nested within said trigger.

14. The apparatus according to claim 11, further including biasing means for maintaining said secondary sear block in the block position.

15. The apparatus according to claim 11, further including a cocking indicator.

16. The apparatus according to claim 11, further including a trigger return spring.

17. The apparatus according to claim 16, further including an adjustment screw between said trigger return spring and said trigger.

18. An improved firearm, said firearm including:

(a) a frame;

(b) a barrel attached to said frame;

(c) a firing mechanism;

(d) a step having an adjustable step height;

(e) a sear and step trigger assembly having a trigger and a secondary sear block, said secondary sear block selectively movable between a first blocking position and a second non-blocking position, wherein said secondary sear block is finger actuated next to said finger portion of the; trigger and (f) an over travel stop.

19. The apparatus according to claim 18, wherein said over travel stop is located between said trigger and said frame.

20. The apparatus according to claim 19, wherein said over travel stop is located rearward said trigger.

21. The apparatus according to claim 20, wherein said over travel stop is an adjustment screw.

22. The over travel stop according to claim 19, further including a trigger stop and safety.

23. The apparatus according to claim 22, wherein said trigger stop and safety is an adjustment screw.

24. The apparatus according to claim 18, wherein said frame is a bolt-action receiver.

25. The apparatus according to claim 18, wherein said firing mechanism includes a firing pin and a firing pin actuator.

26. The apparatus according to claim 25, wherein said firing pin actuator is a spring.

27. The apparatus according to claim 18, wherein said secondary sear block is coaxial with said trigger.

28. The apparatus according to claim 27, wherein said secondary sear block is nested within said trigger.

29. The apparatus according to claim 18, further including biasing means for maintaining said secondary sear block in the block position.

30. The apparatus according to claim 18 further including a cocking indicator.

31. The apparatus according to claim 18, further including a trigger return spring.

32. The apparatus according to claim 31, further including an adjustment screw between said trigger return spring and said trigger.

* * * * *

UNITED STATES PATENT AND TRADEMARK OFFICE

CERTIFICATE OF CORRECTION

PATENT NO. : 6,553,706 B1
DATED : April 29, 2003
INVENTOR(S) : Gancarz et al.

It is certified that error appears in the above-identified patent and that said Letters Patent is hereby corrected as shown below:

Column 4,
Lines 19-28,
Claim 1 should read:

1. An improved firearm, said firearm including:
   (a) a frame;
   (b) a barrel attached to the frame;
   (c) a firing mechanism; and
   (d) a sear and step trigger assembly having a trigger and a secondary sear block, said trigger and said secondary sear block having a common pivot point, said secondary sear block selectively movable between a first blocking position and a second non-blocking position, wherein said secondary sear block is finger actuated next to the finger portion of said trigger.

Lines 48-58,

11. An improved firearm having a frame, a barrel and a firing mechanism, the improvement comprising a sear and step trigger assembly with a secondary sear block, said sear and step trigger assembly comprising:
   (a) a sear;
   (b) a trigger;
   (c) a step having an adjustable step height; and
   (d) a secondary sear block, said trigger and said secondary sear block having a common pivot point, said secondary sear block selectively movable between a first blocking position and a second non-blocking position, wherein said secondary sear block is finger actuated next to the finger portion of said trigger.

UNITED STATES PATENT AND TRADEMARK OFFICE

CERTIFICATE OF CORRECTION

PATENT NO. : 6,553,706 B1
DATED : April 29, 2003
INVENTOR(S) : Gancarz et al.

It is certified that error appears in the above-identified patent and that said Letters Patent is hereby corrected as shown below:

Column 5,
Lines 22-23,

Claim 20 should read:

20. An improved firearm, said firearm including:
(a) a frame;
(b) a barrel attached to said frame;
(c) a firing mechanism;
(d) a step having an adjustable step height;
(e) a sear and step trigger assembly having a trigger and a secondary sear block, said trigger and said secondary sear block having a common pivot point, said secondary sear block selectively movable between a first blocking position and a second non-blocking position, wherein said secondary sear block is finger actuated next to the finger portion of said trigger; and
(f) an over travel stop.

Signed and Sealed this

Second Day of September, 2003

JAMES E. ROGAN
*Director of the United States Patent and Trademark Office*